United States Patent [19]

Hemsath et al.

[11] 3,997,376

[45] Dec. 14, 1976

[54] SPRAY MIST COOLING METHOD

[75] Inventors: Klaus H. Hemsath, Sylvania, Ohio; Frank J. Vereecke, Palmyra, Mich.

[73] Assignee: Midland-Ross Corporation, Cleveland, Ohio

[22] Filed: June 19, 1974

[21] Appl. No.: 480,920

[52] U.S. Cl. ..... 148/143; 62/64; 134/36; 134/37; 148/153; 148/157

[51] Int. Cl.[2] ..... C21D 1/18

[58] Field of Search ..... 148/153, 143, 157; 62/64; 134/34, 36, 37

[56] References Cited

UNITED STATES PATENTS 3,659,428 5/1972 Kunioka et al. ..... 148/143

*Primary Examiner*—R. Dean

*Attorney, Agent, or Firm*—Frank J. Nawalanic

[57] ABSTRACT

A cooling arrangement is provided for cooling a moving stream of heated workpieces without thermal deformation. The arrangement includes a plurality of nozzles circumscribing the work which direct a spray mist of atomized water particles toward the work. The spray mist vaporizes at or near the surface of the work to produce a water vapor. By orientating the nozzle spray mist pattern in a predetermined manner and providing a plurality of axially spaced mist arrays, the water mist developed completely envelops the workpiece in a controlled manner to produce a uniform rate of cooling of the pieces.

5 Claims, 5 Drawing Figures

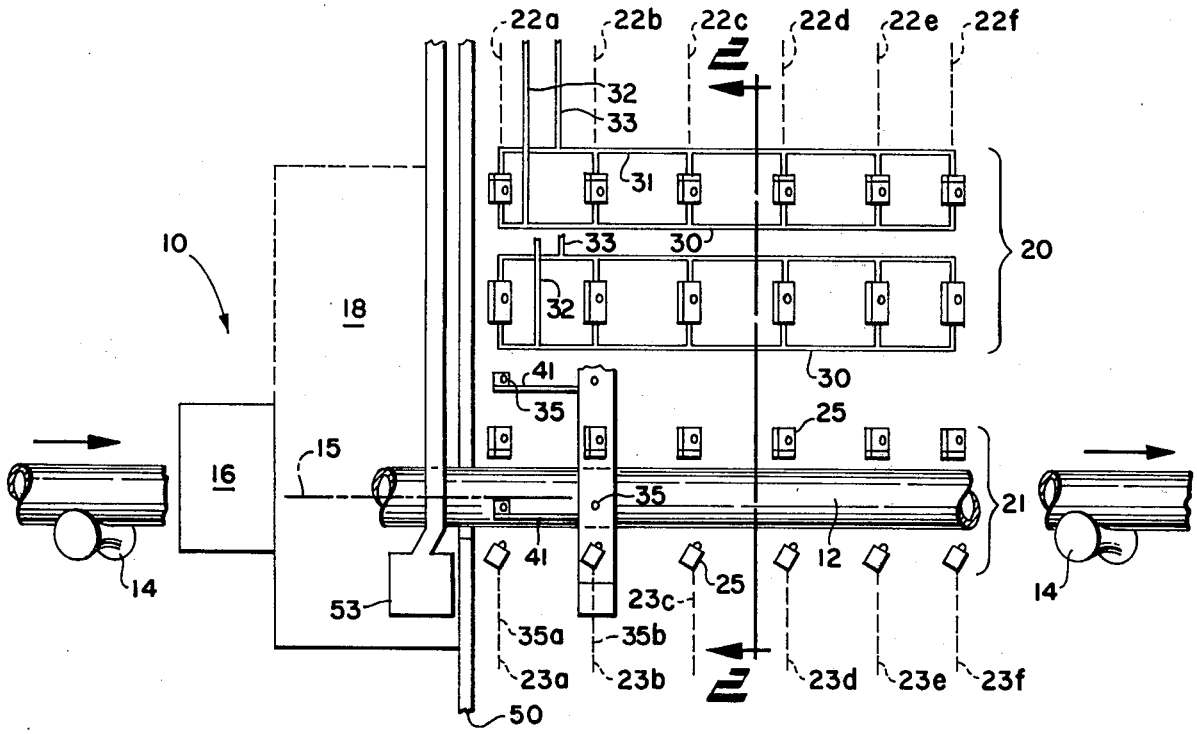
FIG. 1
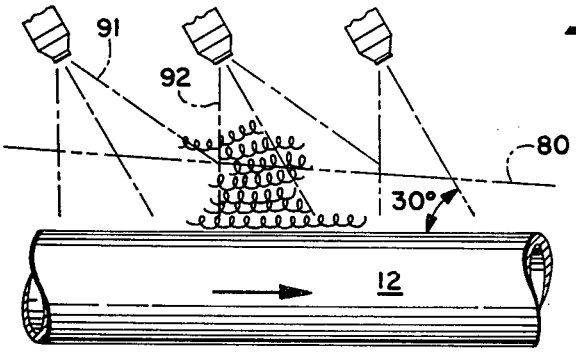
FIG. 4
FIG. 5
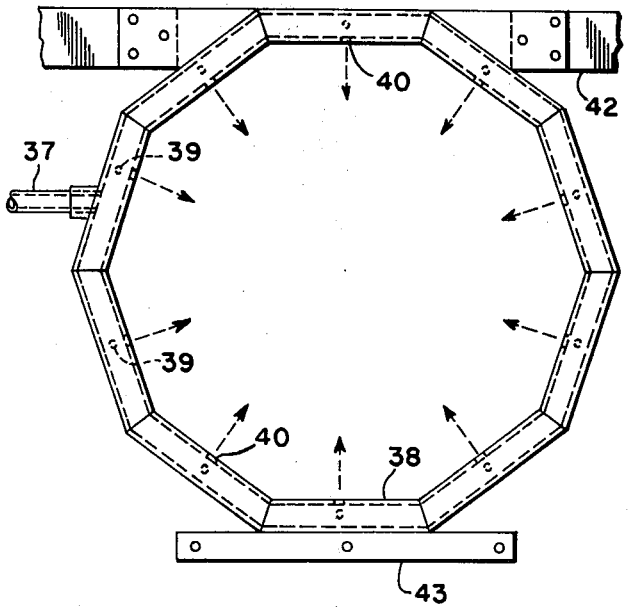
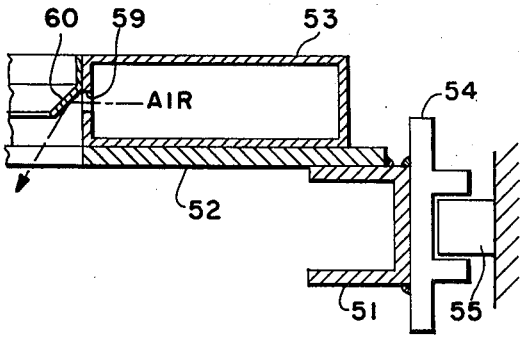
FIG. 3

SPRAY MIST COOLING METHOD

This invention relates generally to cooling a continuous stream of heated workpieces and, more particularly, to such arrangements whereby the workpiece is cooled by a plurality of nozzle sprays axially spaced along the path of movement.

The invention is particularly applicable to cooling stainless steel pipe and will be described with particular reference thereto. However, it will be appreciated by those skilled in the art that the invention is not limited to stainless steel nor to circular objects but specifically may be applied for cooling other materials and object shapes such as flat plates or even metal strip.

In the heat treatment of stainless steel pipe, it is desirable to increase the corrosion resistance of the pipe by heating the pipe to a temperature exceeding 1900° F. followed by a gradually controlled cooling of the pipe to a temperature below 800° F. In heat treating facilities for pipe, various pipe lengths and pipe sizes are continuously fed from a furnace or heat source by means of rollers or belts which are skewed relative to the longitudinal axis of the pipe whereby the pipe simultaneously rotates about its axis while traveling in a longitudinal direction. Extensive attempts have been made to cool such pipe by passing the pipe continuously through known water spray arrangements such as those described in U.S. Pat. Nos. 2,776,230; 3,407,099 and 3,671,028. Such water spray arrangements basically comprise a plurality of axially spaced nozzle arrangements with each array comprising a plurality of nozzles spaced equally about an imaginary circle concentric with the diameter of the pipe. It was found after extensive variations of nozzle water spray and nozzle orientation that the best cooling of the pipe under such arrangements would result in a marked helical indentation about the pipe's surface.

During such experiments, it was also noted that when the water from the first set of nozzles impinged against the pipe, the heat from the pipe would boil the spray to produce a boiling film of steam enveloping the pipe's surface. This boiling steam film would be reduced by the sprays from successive nozzle units during which time the pipe experienced a somewhat uniform rate of cooling at a relatively slow rate. Importantly, it was observed that at some point on the pipe downstream from the first nozzle units, the water spray or water droplets broke through such steam film and directly impinged against the surface of the pipe. At this point, a drastic increase in cooling rate of the pipe occurred. This increased cooling rate causes deformation because cooling is not uniform over the pipe's surface.

It is thus an object of the subject invention to provide a cooling arrangement for controlled cooling a heated workpiece of uniform thickness continuously moving through the cooling arrangement which permits the piece to be cooled without thermal deformation.

It is another object of the subject invention to provide a cooling arrangement which cools a heated workpiece at a substantially uniform rate as the workpiece moves through the arrangement.

These objects along with other features of the subject invention are achieved in a cooling arrangement generally similar to the type referred to above, but employing among other things, a plurality of atomizing spray mist nozzles equally spaced about circles concentric with the longitudinal axis of the pipe. Each plurality of nozzles defines a mist spray unit and a plurality of such mist units are provided in equally spaced axial increments. Each atomizing nozzle generates a spray mist of finely atomized water particles of such size that the particles tend to float in air. When such spray mists are directed towards the pipe, they vaporize at or near the pipe surface into water vapor. By controlling the spray mist patterns of the nozzles to overlap one another, an extremely turbulent air layer with water mist and water vapor is formed and completely envelopes the pipe. The water mist content of this layer is constantly replenished by the atomized spray mist from successive spray mist units to produce a constant cooling rate which does not result in thermal deformation of the pipe. The water mist in the air layer does not allow a drastic change in heat transfer to occur.

In accordance with another feature of the subject invention, conventional water spray nozzles may be interspersed amongst the atomizing spray mist nozzles in those mist units spaced closest to the heat source when thick wall pipe is to be cooled. In such instances, the heat generated from the larger mass is sufficient to vaporize all the water spray impinging on the pipe without resulting in the highly localized cooling rates that one would experience with these water sprays at lower pipe temperature and/or less pipe mass. The atomized spray mist units spaced downstream from the water nozzles are then sufficient to finally cool the pipe to desired temperature, thus resulting in a controlled rate of cooling.

In accordance with still another feature of the subject invention, an arrangement is provided for cooling a wide variety of workpiece sizes. The arrangement includes a frame, on one side of which is a backplate. Mounted to one side of the backplate is a first plurality of mist spray units for treating a relatively wide range of pipe sizes. Below the first cooling arrangement is a second plurality of mist units for treating a second relatively wide range of pipe sizes. Water and air piping necessary for the nozzles is contained entirely within the framework. On the opposite side of the backplate is mounted an air knife-edge arrangement fed from a common air manifold sufficient to prevent backflow or upstream movement of the spray mist past the cooling arrangement. Guides are mounted on the framework to permit vertical movement of the entire cooling arrangement relative to the ground.

It is thus another object of the subject invention to provide a uniform rate of cooling of a moving heated workpiece by a cooling arrangement which envelops the piece therein by a turbulent mixture of water mist and air.

It is yet another feature of the subject invention to provide a cooling arrangement for heated, uniformly thick workpieces which is adaptable to treat a wide variety of workpiece sizes.

Another detaled object of the subject invention is to provide controlled cooling arrangement for gradually cooling stainless steel pipe.

The invention may take physical form in certain parts and arrangement of parts, a preferred embodiment of which will be described in detail herein and illustrated in the accompanying drawings which form a part hereof and wherein:

FIG. 1 is a general schematic representation of the cooling arrangement;

FIG. 3 is a detailed view of the cooling arrangement showing the air knife-edge taken along line 3—3 of FIG. 2;

FIG. 4 is a schematic view portraying a longitudinal view of the spray from several of the nozzles; and FIG. 5 is a view of the water spray manifold.

Figure 2:
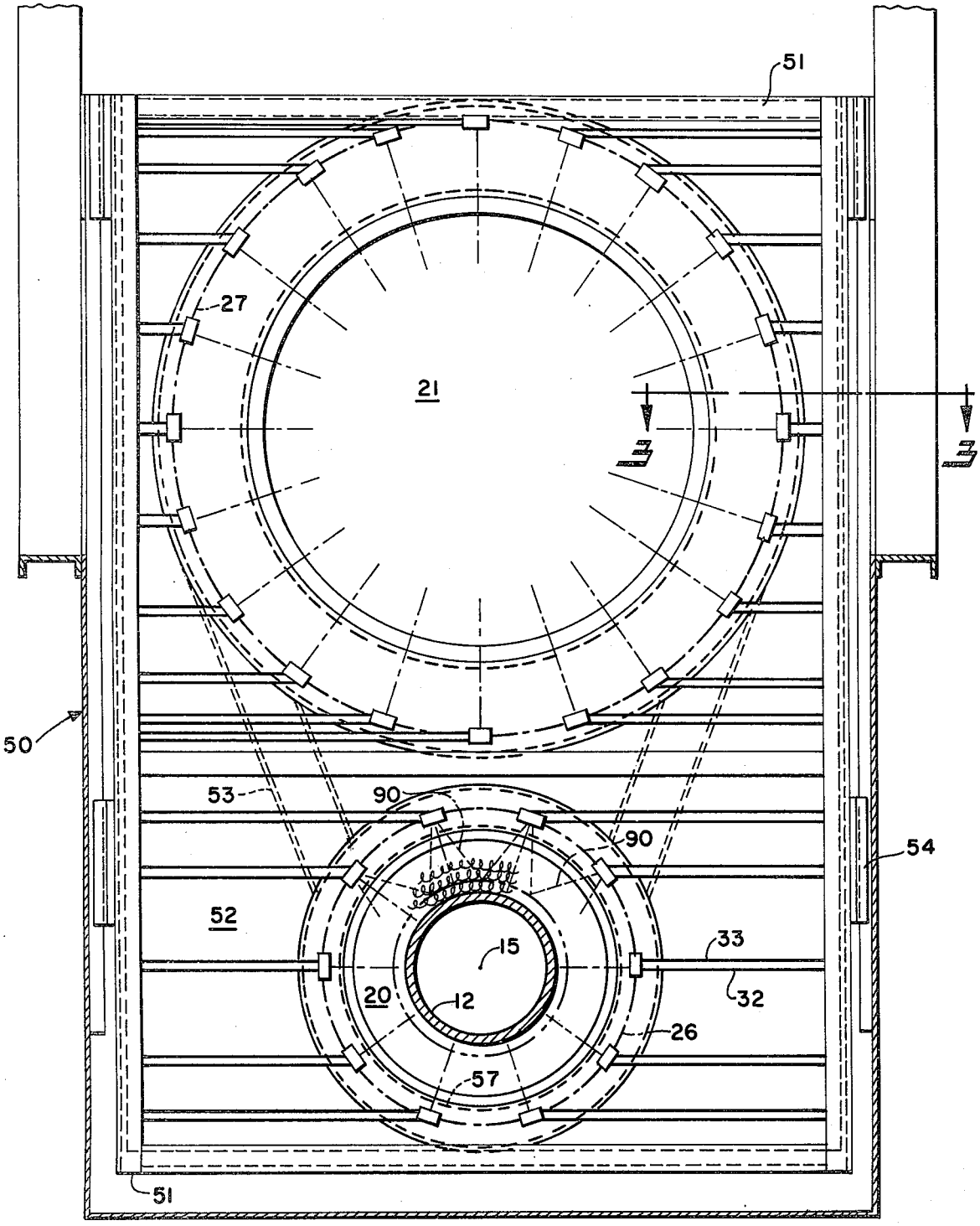
FIG. 2 is a schematic cross-sectional view of the cooling arrangement taken along line 2—2 of FIG. 1.

Referring now to the drawings wherein the showings are for the purpose of illustrating a preferred embodiment of the invention only and not for the purpose of limiting same, FIG. 1 shows an arrangement 10 for cooling stainless steel pipe 12 conveyed by rollers 14 skewed relative to the longitudinal pipe centerline 15 which move pipe 12 lengthwise through a heat source designated generally as 16, through a shroud or enclosure designated generally as 18 and through the cooling arrangement.

Cooling arrangement 10 includes an upper nozzle arrangement 20 especially adapted for cooling large diameter thin wall pipe and a lower nozzle arrangement 21 especially adapted for cooling thick wall, smaller diameter pipe. Both upper and lower nozzle arrangements 20, 21 include a plurality of upper and lower mist spray units (six) identified respectively as 22*a–f*, 23*a–f* which are axially or longitudinally spaced at equal increments relative one another. Other pluralities may be employed. Each mist unit 22, 23 includes a plurality of conventional atomizing spray mist nozzles 25 and the atomizing nozzles constituting any one of the mist units arranged in equally spaced, circumferential increments about circles, indicated as 26 for lower mist units 23 and 27 for upper mist units 22. As shown in FIG. 2, circles 26, 27 are concentric with the center 15 of pipe 12.

Referring again to FIG. 1, each nozzle 25 in any mist unit 22, 23 is in longitudinal alignment with a corresponding nozzle in an adjacent mist unit. This alignment lends itself to a relatively simple piping arrangement which is diagrammatically illustrated for the upper nozzle arrangement 20, although not specifically shown for the lower nozzle arrangement 21. More specifically, a common water line 30 and a common air line 31 fed respectively by a main water line 32 and a main air line 33 supply pressurized water and air to those atomizing spray mist nozzles in longitudinal alignment with one another.

In the lower nozzle arrangement and spaced in equal increments between atomizing spray mist nozzles 25 of first and second lower mist units 23*a*, 23*b* are a plurality of conventional water nozzles 35. The array of water nozzles within lower mist unit 23*b* is designated 35*b* and similarly the array of water nozzles within lower mist unit 23*a* is designated 35*a*. As best shown in FIG. 5, water under pressure is supplied to water nozzles 35 by a main water pipe 37 which in turn is directed into square stainless steel tubing formed in a polygon to define a water manifold 38. At the center of each straight side of water manifold 38 is a water outlet 39 which serves as a coupling for conduit 41 (FIG. 1) connected to water nozzles 35 in first water spray unit 35*a*. Also at the inside center of each straight side of water manifold 38 are couplings 40 directed toward the center of the water manifold and to which are secured water nozzles 35 in second water spray unit 35*b*. Brackets 42, 43 are secured to the water manifold at top and bottom respectively for mounting purposes. Other spray arrangements will suggest themselves to those skilled in the art.

Referring now to FIGS. 1 and 2, upper and lower spray arrangements 20, 21 and water manifold 38 are mounted on one side of a support frame diagrammatically shown at 50 in FIG. 1 and on the opposite side of support frame 50 an air, knife-edge manifold 53 is mounted. As best shown in FIGS. 2 and 3, support frame 50 basically comprises a rectangular frame formed of channel 51 which supports all main water and air lines 32, 33 and 37 necessary to operate nozzles 25, 35. Attached to one side of rectangular channel frame 51 is a backplate 52 to which upper and lower spray units 20, 21 are secured.

Also attached to the outside of the two vertically extending channel sides of the rectangular frame are guides 54. As best shown in FIG. 3, guides 54 receive vertically rising steel blocks 55 which in turn are fixed to suitable support framework (not shown) to permit the entire support frame 50 to be raised or lowered relative to heat source 16 whereby either upper 20 or lower 21 cooling arrangement may be employed.

Secured to the opposite side of backplate 52 is hollow air manifold 53 formed into upper and lower circular portions shown in dot-dash lines in FIG. 2 as 57, 58 which are concentric with pipe 12. Air under pressure is supplied to air manifold 53 from a source (not shown) and exits therefrom by means of a narrow annular slit 59 cut about the interior of each circular portion 57, 58 of air supply manifold 53. Extending over slit 59 and angled in the direction of pipe movement is a tab or baffle 60 which serves to project the air leaving slit 59 in a downstream direction for purposes to be explained hereafter.

The operation of cooling arrangement 10 will be first described with support frame 50 vertically lowered to a position whereat upper spray mist nozzle arrangment 20 is in concentric relation with the longitudinal centerline 15 of pipe 12. As noted previously, pipe 12 is conveyed lengthwise and in a rotational manner by rollers 14 located upstream of heat source 16 and downstream of cooling arrangement 10 whereby pipe 12 is heated to a predetermined temperature by source 16, passes through enclosure 18 which prevents ambient atmosphere from affecting the cooling operation and passes through air manifold 53 where a circular knife-edge air pattern emanating from slit 59 impinges against the pipe. This air pattern not only provides a barrier shield preventing spray in the cooling arrangement from traveling upstream but also prevents the furnace type atmosphere in enclosure 18 from being adversely affected by the air from the knife-edge because baffle 60 directs such air in a downstream direction.

The pipe is then subjected to a fine spray mist from atomizing spray mist nozzles 25 in the first mist unit 22*a*. More particularly, each atomizing spray mist nozzle is supplied with water at approximately 10–50 psi and air at approximately 50–70 psi to produce very fine water droplets of a size which tend to float in air. The water droplets are in effect carried by the air spray patterns developed by the atomizing spray mist nozzles. The spray mist pattern produced by the atomizing spray mist nozzles may be basically described as being a fan type flat pattern with a rather wide spray angle. More particularly, the fan pattern is schematically illustrated for the lower cooling arrangement in FIG. 2. As illustrated, the center of each fan spray developed by an atomizing spray mist nozzle, if extended, would intersect with the center of the pipe. Importantly, the side edge 90 of one fan pattern intersects or overlaps with a side edge 90 of an adjacent nozzle's spray mist pattern at some point removed in space from the pipe's surface so as to form an entire annular volume of mist around the pipe. Similarly, the spray mist of the nozzles in a plane perpendicular to the flow of the pipe as depicted in FIG. 4 shows that similar zones of turbulence are created between adjacent spray mist nozzles. That is, a leading spray edge 91 of one nozzle will intersect with the trailing spray edge 92 of an adjacent nozzle to create zones of turbulence. Such turbulent zones in FIG. 4 which are aided by virtue of the momentum of spray mist streams impinging against the pipe's surface interact with the turbulent annular volume of mist produced by nozzle interaction in FIG. 2 to develop a mist annulus which completely surrounds or envelops the pipe along its entire length within cooling arrangement 10. It should be noted that because the angle of the nozzles with respect to a line perpendicular to the pipe's surface is approximately 30° as shown in FIG. 4, that the mist annulus thus developed is tending to flow in the same direction as the pipe travel thereby minimizing the tendency of the spray mist to travel upstream or counter to the pipe flow.

Having defined the spray patterns developed by atomizing spray mist nozzles 25, it should be clear that the fine droplets contained within the air flow from such nozzles will evaporate at some distance from the pipe depending upon the temperature of the pipe, droplet size and mass of pipe. More particularly, a portion of the spray mist emanating from atomizing spray mist nozzles 22*a* will evaporate into water vapor as the mist approaches the pipe. By the time the pipe has reached the next spray mist unit, 22*b*, it is somewhat cooler than it was when it was adjacent mist unit 22*a*. Accordingly, evaporation of the water droplets from spray mist unit 22*b* will occur at a closer distance to the pipe's surface than the evaporation of the droplets from nozzle 22*a*. Since the mist developed by upper nozzle arrangement 20 envelops the entire length of the pipe, the distance from the surface of the pipe at which the droplets vaporize decreases in a gradual progression from a largest distance at the upstream point of the cooling arrangement defined by mist unit 22*a* to a smallest distance at the downstream end of the cooling arrangement defined as 22*f*. This is believed shown by slanting line 80 in FIG. 4 which is indicative of the distance at which vaporization occurs. Line 80 is believed verified by temperature measurements of the pipe which have shown a uniform decrease in the rate of cooling as a function of the travel or distance of the pipe within the cooling arrangement. It was found that as long as the droplets evaporate before contacting the pipe's surface, a gradual, uniform rate of cooling was obtained.

It was also found that when thick wall tubes were to be similarly cooled, the mass of such tubes required an excessive amount of spray mist units. It was further discovered that if water nozzles 35 were interposed between atomizing spray mist nozzles 25 in those mist units closest to the heat source 23*a*, 23*b*, whereat the temperature of the pipe was the highest, a mist would still envelop the pipe but the saturation of the water would be greater than that compared to the mist which would be produced by atomizing spray mist nozzles 25 themselves. That is, the use of the water spray nozzles interspersed between the atomizing mist nozzles produces a more rapid, initial rate of cooling than that which is produced by the use of the atomizing spray mist units themselves. According, it is believed that if the nozzles in the cooling arrangement closest the heat source were varied to produce a greater droplet size than those produced in the successive mist units, a similar result could be obtained. Importantly, the use of the additional water flow by water nozzle arrangements 35*a*, 35*b* does not develop such intensity or supply a sufficient volume of water to directly impinge on and wet the pipe's surface.

When comparing the cooling arrangement of the subject invention with that of other prior art systems mentioned above which employed either completely liquid water sprays or air-water sprays developing droplets of sufficient size not to be suspended within air, it was found that prior art arrangements would result in the formation of a boiling steam film about the pipe at the nozzle units closely adjacent the heat source. In terms of comparison, the water mist of the subject invention which moves closer to the pipe's surface does not, in the end limits, wet the pipe's surface to cause extreme and localized cooling rates to occur as in the prior art. While theoretically the presence of a boiling steam film might be able to be maintained without water spray directly impinging against the pipe until the temperature was reduced to a given value, it was found under extensive tests that the pipe leaving the heat source could never be maintained at a consistent and uniform temperature throughout its circumference. Thus such spray units would break through the steam film at various axial distances along any given pipe length to directly impinge against the pipe's surface. Direct impingement of water against the pipe's surface results in immediate rapid cooling which causes thermal deformation of the pipe. Furthermore, the interaction between such water sprays, while creating turbulent flow conditions, would not produce a spray which would completely envelop the total length of the pipe and uniformly envelop about its cross section within the cooling arrangement. Cooling is thus effected by marked interval decreases in temperature corresponding to the water nozzle spacing. Finally, provisions had to be made in prior art water spray arrangements to prevent the water from entering the ends of the pipes conveyed through the cooling arrangement. If the mist of the subject invention enters the inside of the pipe, no detrimental effects are observed.

In the process thus described, "304" stainless steel pipe has been cooled from approximately 1950° F. to less than 800° F. in approximately 2 minutes by an arrangement employing circle diameters of 46 inches around which atomizing spray nozzles 25 in the upper cooling arrangement 20 are oriented and 28 inches wherein the atomizing spray nozzles in the lower cooling arrangement 21 are orientated. The upper cooling arrangement has successfully cooled stainless steel tubes 20–36 inches in diameter with maximum wall thickness up to three-eighths inch at a uniform cooling rate without thermal deformation. Furthermore, the upper cooling arrangement when supplied with water nozzles 35 interspersed in the atomizing spray mist nozzle unit or row 22*a* will successfully cool stainless steel pipe of 20–36 inches in diameter with wall thickness up to three-fourths inch without thermal deformation. The lower cooling spray mist arrangement 21 with only water nozzle unit 35*a* (not 35*b*) in operation has successfully cooled stainless steel pipe from 12–20 inches in diameter with wall thickness up to three-fourths inch.

In both arrangements, longitudinal spacing between mist units was 5 inches; atomizing spray nozzles were operated at approximately 70–80 psi with 10–50 pounds of water. Water pressure supplied to water nozzles 35 was at 40–60 psig and water spray nozzles 35 had a capacity of 0.067 gallon per minute at 40 psig.

Importantly, it was experimentally determined for the stainless steel pipe treated and believed applicable to any metal object cooled in accordance with the present teachings, that any uniformly thick metal can be cooled 950° within a time period of approximately 2 minutes if the cooling arrangement disclosed was supplied a total volume of water equal to or less than the ratio of 0.05 gallons of water per pound of metal pipe cooled. Other ratios may be experimentally determined for different temperature drops or different cooling times or both. That is, if the material treated was to experience a larger drop than 950° F., or was to be cooled in a shorter time than 2 minutes, it would be expected that the ratio of gallons of water per pound of metal cooled would be greater than 0.05.

It should be understood that the above ratio is only applicable to a turbulent spray mist enveloping the article to be cooled. That is, it was found that if this ratio were met by increasing the water droplet size from the spray mist nozzles to a droplet size which would not float in air, the droplets would impinge against the pipe in a wet manner resulting in an uncontrolled highly localized cooling of the pipe which resulted in thermal deformation. Similarly, when treating thick wall pipe (one-half to three-fourths inch), it was determined as a practical matter that the use of the atomizing spray mist nozzle units would be impractical in that their size would have to be substantially increased along with their number, etc. It was thus discovered that use of the water spray nozzle arrangement as disclosed herein would satisfy the water requirements in the above defined ratio while still developing a spray mist which would not wet the pipe and thereby afford a simple, compact easily controllable cooling arrangement. It should be understood that the cooling rate of the pipe when subjected to the spray mist generated by the combined water spray nozzles 35 and atomized spray mist nozzles 25 will result in an initial cooling rate adjacent the water spray and atomized spray arrangement which is greater than that developed by successive atomizing spray mist nozzle arrangements downstream thereof.

It should be appreciated that water nozzles 35 need not be interspersed between atomizing spray mist nozzles 25 but could be placed in their own array upstream of the first atomizing spray mist units 22*a*, 23*a*.

Because thick wall pipe is functionally viewed as an equivalent to a plate, it is believed that the cooling arrangement thus described is not limited to pipe but may be applied to the cooling of plates. Similarly, it is believed that the cooling arrangement thus disclosed could be applied to cooling moving metal strip without distortion. In its broadest sense, the cooling arrangement of the subject invention is believed applicable to any heated continuously moving article having a uniform thickness.

The invention has been described with reference to a preferred embodiment. Obviously, modifications and alterations will occur to others upon reading and understanding the specifications. For example, specific object shapes made up of different uniformly thick surfaces (i.e. such as an H-beam, channel, etc.) may be cooled according to the teachings herein, if the mist developed were confined to each surface by appropriate barriers and water mist saturation level varied accordingly. It is our intention to include all such modifications and alterations insofar as they come within the scope of the present invention.

It is thus the essence of the invention to provide a cooling arrangement for cooling a moving stream of heated articles of uniform thickness or uniformly thick portions which employs a nozzle arrangement to direct a spray of fluid mist in an envelope which completely surrounds the article and which, before contacting the article, evaporates into a water vapor to cool the heated article at a controlled rate without thermal deformation of the article.

Having thus defined the invention, we claim:

1. A method for cooling a heated workpiece traveling through a cooling arrangement comprising the steps of:

directing a plurality of fan type atomizing spray mists carrying atomized water particles of a size sufficient to float in air in an array surrounding said workpiece at equally spaced distances therefrom;

spacing a plurality of said arrays in axial increments perpendicular to said workpiece;

interacting the side edge of each spray mist in each array with the side edge of an adjacent spray mist in that array at a distance removed from the surface of the workpiece to produce turbulent flows generally in a first plane;

interacting at a distance removed from the surface of the workpiece the leading edge of each spray mist in an array with the trailing edge of an aligned spray mist in an adjacent array to produce turbulent flow generally in a second direction;

interacting said turbulent flows to completely and uniformly envelop said workpiece within said cooling arrangement in an envelope by a turbulently flowing spray mist; and evaporating said spray mist within said envelope by the heat from said workpiece before said spray mist can come into actual physical contact with said workpiece thereby providing a controlled rate of cooling of said workpiece without thermal deformation of said workpiece.

2. The method of claim 1 further including the steps of:

directing towards said workpiece a plurality of fan-shaped water sprays adjacent the leading end of said cooling arrangement;

interacting and combining said water sprays with said spray mists; and evaporating said water sprays at or near the surface of said workpiece to provide a higher rate of cooling of said workpiece adjacent said water sprays than that produced by the other arrays of spray mists.

3. The method of claim 2 further including:

impinging said workpiece with a continuous circumscribing stream of air at the entrance end of said cooling arrangement to prevent spray flow therethrough;

directing said stream of air in angular relationship to the flow of said workpiece to prevent said air stream from spreading in a direction countercurrent to work flow; and directing said sprays in angular relationship to said workpiece so that said sprays tend to flow in a direction parallel to the work flow.

4. The method of claim 2 wherein said workpiece is cooled approximately 950° F. in a time period of approximately two minutes further including the step of:

supplying water to said cooling arrangement at the rate not to exceed 0.05 gallons of water per pound of workpiece material treated.

5. The method of claim 4 further including the steps of:

supplying water to said mist nozzles between 10 and 50 pounds; and supplying air to said nozzles at approximately 50–70 psig.

* * * * *